US009228325B2

(12) United States Patent
Campomanes

(10) Patent No.: US 9,228,325 B2
(45) Date of Patent: Jan. 5, 2016

(54) TOOL RETENTION SYSTEM

(71) Applicant: Caterpillar Inc., Peoria, IL (US)

(72) Inventor: Patrick Simon Campomanes, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 186 days.

(21) Appl. No.: 13/920,539

(22) Filed: Jun. 18, 2013

(65) Prior Publication Data

US 2014/0366408 A1 Dec. 18, 2014

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ..... E02F 9/2808; E02F 9/2816; E02F 9/2825; E02F 9/2833; E02F 9/2858
See application file for complete search history.

(56) References Cited

U.S. PATENT DOCUMENTS

| | | | | |
|---|---|---|---|---|
| 1,992,591 | A * | 2/1935 | Whisler | 37/456 |
| 4,357,765 | A * | 11/1982 | Seykora | 37/455 |
| 4,433,496 | A | 2/1984 | Jones et al. | |
| 5,410,826 | A | 5/1995 | Immel et al. | |
| 5,438,774 | A | 8/1995 | Fletcher et al. | |
| 5,452,529 | A | 9/1995 | Neuenfeldt et al. | |
| 5,784,813 | A | 7/1998 | Balassa et al. | |
| 5,868,518 | A | 2/1999 | Chesterfield et al. | |
| 5,964,547 | A | 10/1999 | Brinkley | |
| 6,009,644 | A | 1/2000 | Hedley | |
| 6,301,810 | B1 | 10/2001 | Fidler | |
| 6,986,216 | B2 | 1/2006 | Emrich et al. | |
| 7,299,570 | B2 * | 11/2007 | Emrich et al. | 37/455 |
| 7,516,564 | B2 * | 4/2009 | Ruvang | 37/456 |
| 7,640,684 | B2 | 1/2010 | Adamic et al. | |
| 8,458,931 | B2 * | 6/2013 | Knight | 37/456 |
| 8,898,937 | B2 * | 12/2014 | Campomanes | 37/456 |
| 8,978,277 | B2 * | 3/2015 | Knight | 37/456 |

(Continued)

FOREIGN PATENT DOCUMENTS

| | | |
|---|---|---|
| EP | 1939362 | 7/2008 |
| WO | WO 0020696 A1 * | 4/2000 |
| WO | 0125551 | 4/2001 |

OTHER PUBLICATIONS

U.S. Appl. No. 13/862,114 of Marcus John Guethle et al. entitled "Steering Linkage Arrangement for Articulated Mobile Machine" filed Apr. 12, 2013.

(Continued)

*Primary Examiner* — Jamie L McGowan
(74) *Attorney, Agent, or Firm* — Finnegan, Henderson, Farabow, Garrett & Dunner, LLP

(57) ABSTRACT

A retention system is provided for use with a ground engaging tool. The tool retention system may have a generally C-shaped clamp configured to be disposed within an aperture of a work implement and to engage apertures in a tool adapter. The retention system may also have a wedge configured to be disposed within the apertures of the tool adapter and the work implement and against the generally C-shaped clamp. The retention system may additionally have a generally C-shaped slider configured to be disposed within the apertures of the tool adapter and to engage the aperture of the work implement. The C-shaped slider may have an opening oriented away from the generally C-shaped clamp, and the retention system may further have a fastener configured to connect the generally C-shaped slider to the wedge.

20 Claims, 4 Drawing Sheets

(56) References Cited

U.S. PATENT DOCUMENTS

| | | | | |
|---|---|---|---|---|
| 2004/0216334 | A1* | 11/2004 | Emrich et al. | 37/452 |
| 2008/0276500 | A1* | 11/2008 | Ruvang | 37/452 |
| 2011/0072693 | A1 | 3/2011 | Knight | |
| 2013/0318839 | A1* | 12/2013 | Bierwith | 37/444 |
| 2014/0082977 | A1* | 3/2014 | Pilon | 37/453 |
| 2015/0096207 | A1* | 4/2015 | Tasovski | 37/456 |

OTHER PUBLICATIONS

U.S. Appl. No. 13/914,297 of Garrett D. Knight entitled "Excavator Tooth Retention Device" filed Jun. 10, 2013.
http://xml.catmms.com/servlet/ImageServlet?imageId=C609127 &imageType=2, pp. 1-24.
http://xml.catmms.com/servlet/ImageServlet?imageId=C743073 &imageType=2, pp. 1-20.

* cited by examiner

TOOL RETENTION SYSTEM

TECHNICAL FIELD

The present disclosure relates generally to a retention system and, more particularly, to a system for retaining a ground engaging tool connected to a work implement.

BACKGROUND

Earth-working machines, such as excavators, wheel loaders, electric cable shovels, and front shovels, include implements generally used for digging into, ripping, or otherwise moving earthen material. These implements are subjected to extreme abrasion and impacts that causes them to wear. To prolong the useful life of the implements, various ground engaging tools can be connected to the earth-working implements at areas experiencing the most wear. These ground engaging tools are replaceably connected to the implements using a retention system.

An exemplary retention system is disclosed in U.S. Patent Publication 2011/0072693 of Knight that published on Mar. 31, 2011 ("the '693 publication"). Specifically, the '693 publication discloses a fork-shaped tool body that fits over the edge of an excavator bucket. A clamp passes through the body and the bucket, and a wedge is inserted alongside the clamp to hold the clamp in position. The wedge has a U-shaped axial recess, and a threaded rod is received within the recess and oriented at an angle relative to the clamp. A threaded block is mounted to the rod, and the rod is rotatable to move the block along the rod. The block includes teeth that engage the clamp upon insertion of the wedge into the body, such that as the rod is rotated and the block moves along the rod, the wedge is forced further into the body. As the wedge is forced further into the body, the clamp is urged tighter against the body and the bucket. A resilient cap makes a friction fit with an end of the rod after assembly, thereby inhibiting inadvertent rotation of the rod. With this configuration, the fork-shaped tool body can be removably connected to the excavator bucket by rotation of the rod.

Although acceptable for some applications, the retention system of the '693 publication may be less than optimal. In particular, the toothed engagement between the block and the clamp may be a costly feature that has geometry that is difficult to control during manufacturing. In addition, after a period of wear, the clamp may become loose, requiring further adjustment of the rod. In some situations, the amount of adjustment required to tighten the joint may require replacement of the clamp with a different size of clamp, which can be expensive for an owner of the machine. Further, as the retention system wears and is adjusted, it may be possible for the wedge to be moved too far into the tool body, making replacement difficult.

The disclosed tool retention system is directed to overcoming one or more of the problems set forth above.

SUMMARY

According to one exemplary aspect, the present disclosure is directed to a retention system. The retention system may include a generally C-shaped clamp configured to be disposed within an aperture of a work implement and to engage apertures in a tool adapter. The retention system may also include a wedge configured to be disposed within the apertures of the tool adapter and the work implement and against the generally C-shaped clamp. The retention system may additionally include a generally C-shaped slider configured to be disposed within the apertures of the tool adapter and to engage the aperture of the work implement. The C-shaped slider may have an opening oriented away from the generally C-shaped clamp, and the retention system may further include a fastener configured to connect the generally C-shaped slider to the wedge.

According to another exemplary aspect, the present disclosure is directed to a retention cap for a fastener. The retention cap may include a generally cylindrical body defining a hollow interior, and a protrusion extending radially away from the generally cylindrical body. The retention cap may also include a plurality of friction enhancing ribs configured to engage a head of the fastener and inhibit rotation thereof.

According to yet another exemplary aspect, the present disclosure is directed to a slider for a tool retention system. The slider may include a generally C-shaped member having a middle section and spaced apart arms located at ends of the middle section. The slider may also include a generally cylindrical protrusion connected to a closed side of the middle section, and a threaded bore formed within the generally cylindrical protrusion.

DETAILED DESCRIPTION

Figure 1:
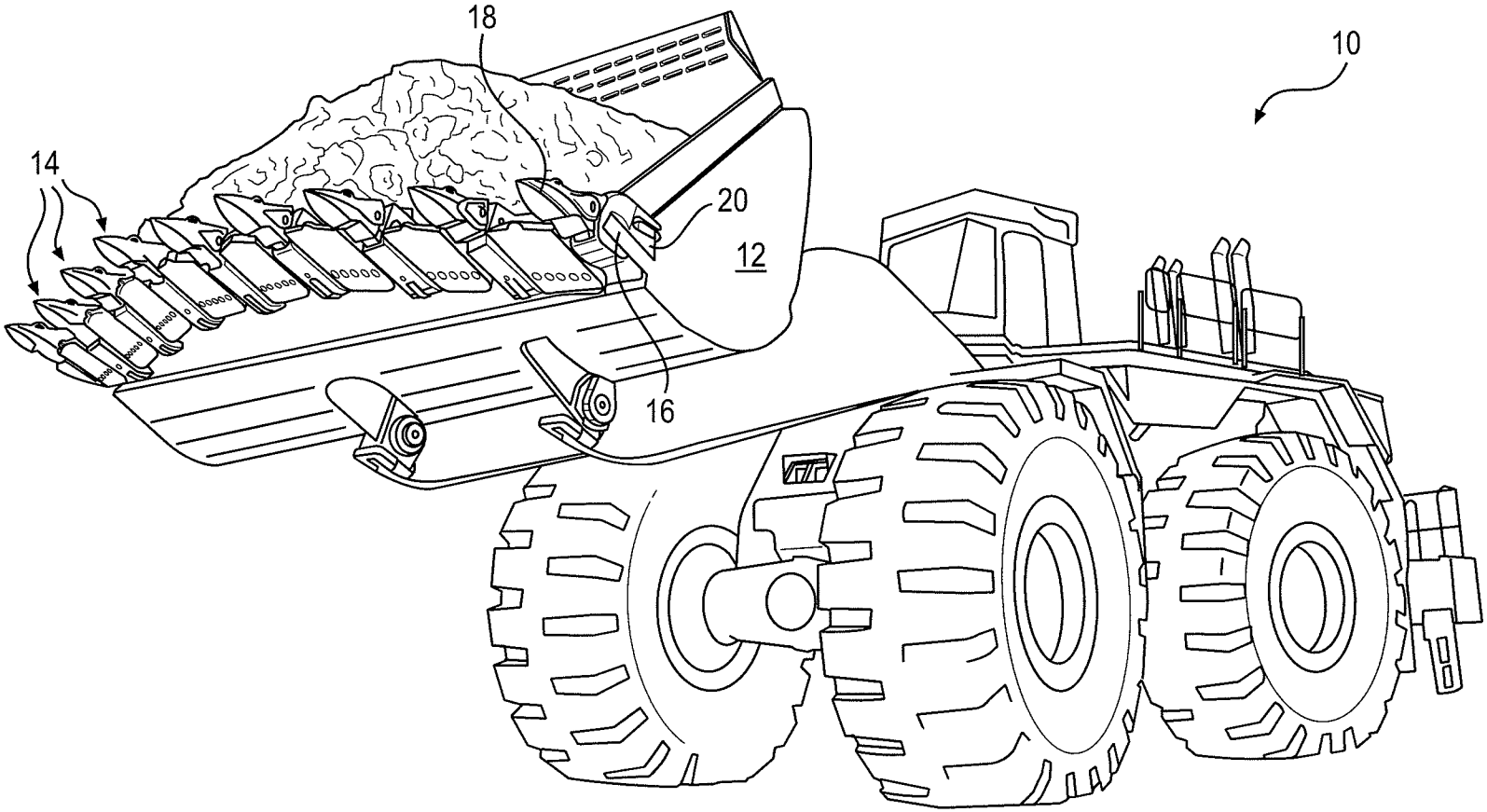
FIG. 1 is an isometric illustration of an exemplary disclosed machine.

FIG. 1 illustrates a mobile machine 10 having a work implement 12 operatively connected at a leading end. In the disclosed embodiment, machine 10 is a wheel loader. It is contemplated, however, that machine 10 may embody any other type of mobile or stationary machine known in the art, for example an electric cable shovel, an excavator, a motor grader, a dragline machine, a dredge, or another similar machine. Machine 10 may be configured to use work implement 12 to move material, such as earthen material, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform a particular task such as, for example, a bucket (shown in FIG. 1), a blade, a shovel, a crusher, a grapple, a ripper, or any other material moving device known in the art. In addition, although connected in the embodiment of FIG. 1 to lift, curl, and dump relative to machine 10, work implement 12 may alternatively or additionally rotate, swing, pivot, slide, extend, open/close, or move in another manner known in the art.

Work implement 12 may be equipped with one or more ground engaging tools (GET) 14 located at a cutting edge 16. For example, the disclosed bucket is shown as being provided with nine similar tooth assemblies that are spaced apart along the length of cutting edge 16. While shown as single-point, sharpened tooth assemblies, it is contemplated that GET 14 could take any other form known in the art, for example a fork (i.e., multi-point) configuration, a chisel (i.e., blade) configuration, or a blunt-end configuration.

GET 14 may be a conventional single-piece component or multi-piece component that is removably connected to work implement 12. In the embodiment shown in FIG. 2, GET 14 is a two-piece component having a tip 18 and an adapter 20 that are connected to cutting edge 16 of work implement 12 via a retention system 22. Tip 18 may be joined to a nose end 24 of adapter 20 in any manner known in the art, for example via welding, threaded fastening, integral posts and clips, etc. Thereafter, retention system 22 may be used to removably connect GET 14 to work implement 12.

Retention system 22 may include components that interact to clamp an associated GET 14 in a removable manner to cutting edge 16 of work implement 12. Specifically, retention system 22 may include a clamp 26, a wedge 28, a slider 30, a fastener 32, and a retention cap 34. As will be described in more detail below, clamp 26 may pass through adapter 20 and work implement 12, and wedge 28 may be used to hold clamp 26 in place. Slider 30 may engage work implement 12 and be connected to wedge 28 by fastener 32. Retention cap 34 may be used to inhibit unintentional removal of fastener 32 and disassembly of retention system 22.

Adapter 20 may include legs 38 that extend in a direction away from nose end 24. Legs 38 may be spaced apart from each other to form a recess 40 therebetween that is large enough to receive cutting edge 16 of work implement 12. An elongated aperture 42 may be formed within each leg 38, and apertures 42 may be generally aligned with each other and with a corresponding aperture 44 in work implement 12. A trailing end of legs 38 may taper inward toward apertures 42, such that a thickness of each leg 38 is less at aperture 42 than at a distal end 46 of leg 38. In some embodiments, a lifting eye 48 may be associated with adapter 20 to facilitate installation and removal thereof using a crane or other lifting device.

Clamp 26 may be generally C-shaped, having a middle section 50 and spaced-apart arms 52 located at opposing ends of middle section 50. Clamp 26 may be inserted through apertures 42 of adapter 20 and aperture 44 of work implement 12, with an open side of clamp 26 oriented away from cutting edge 16. Inner surfaces 54 of arms 52 may be configured to engage the outer tapered surfaces at distal ends 46 of both legs 38, such that as clamp 26 is moved away from cutting edge 16, the taper will cause arms 52 to generate inward forces (i.e., toward recess 40) that sandwich work implement 12 between legs 38. Middle section 50 of clamp 26 may have an inner (relative to the C-shape) surface 54 that is generally planar and aligned with an axis 56 of apertures 42, 44, and a generally flat outer surface 58 that is inclined relative to axis 56. As clamp 26 is moved away from cutting edge 16, inner surface 54 may engage an inner end surface of apertures 42 and/or 44. In some embodiments, a longitudinal channel 60 may be formed within outer surface 58 and used to connect wedge 28 to clamp 26, as will be described in more detail below. Additionally, a release feature (e.g., a lifting eye) 62 may be included in some designs to facilitate installation and/or removal of clamp 26, if desired.

Figure 2:
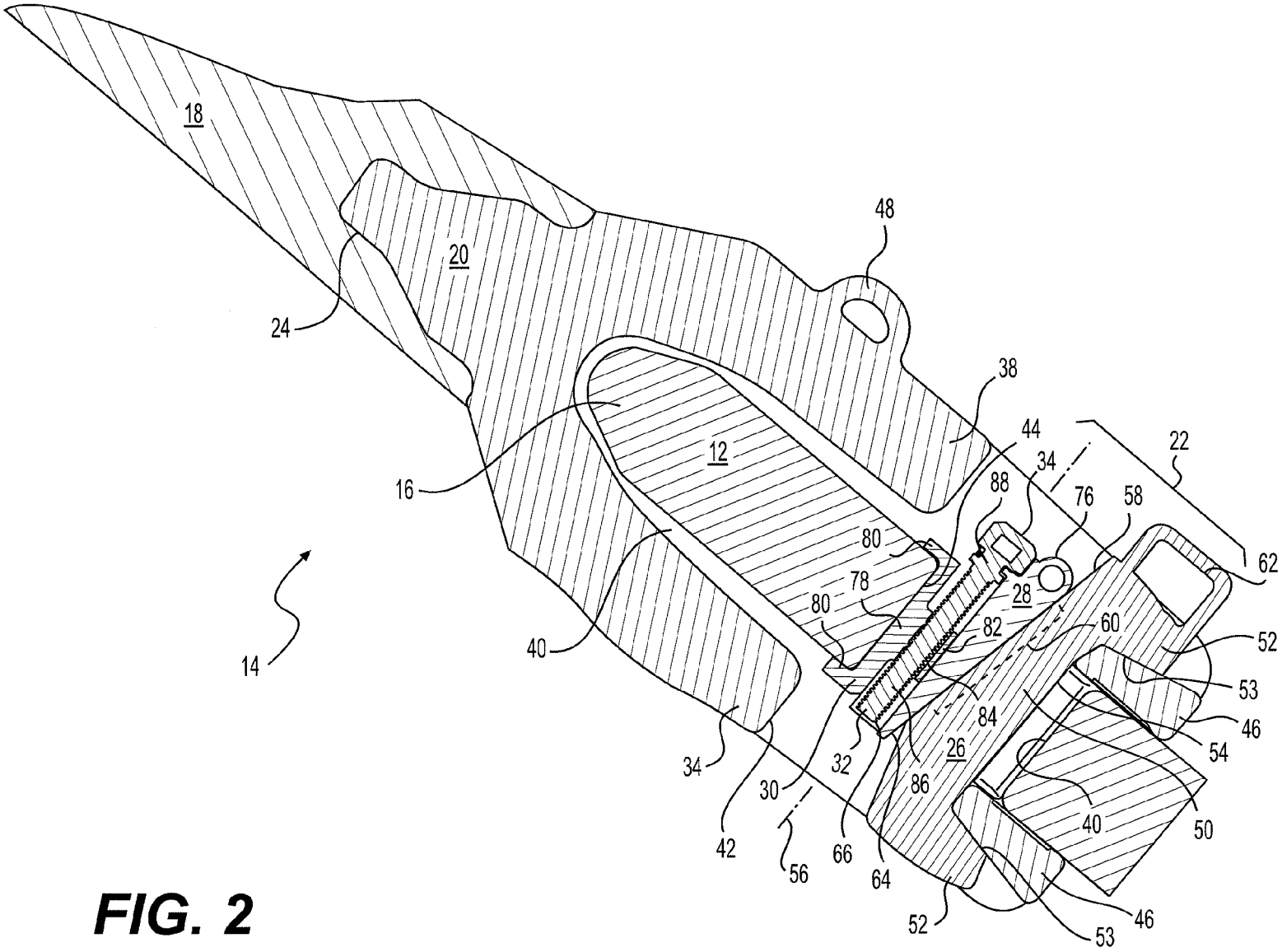
FIG. 2 is a cross-sectional side view illustration of an exemplary disclosed tool retention system that may be used in conjunction with the machine of FIG. 1.
Figure 4:
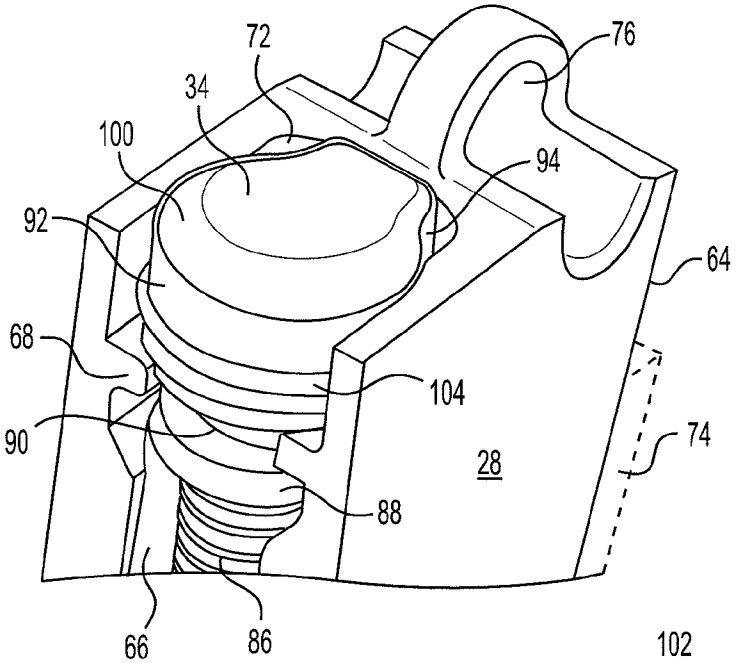
FIG. 4 is an isometric illustration of the wedge of FIG. 3 together with an exemplary disclosed fastener and locking cap that form portions of the tool retention system of FIG. 2.
Figure 3:
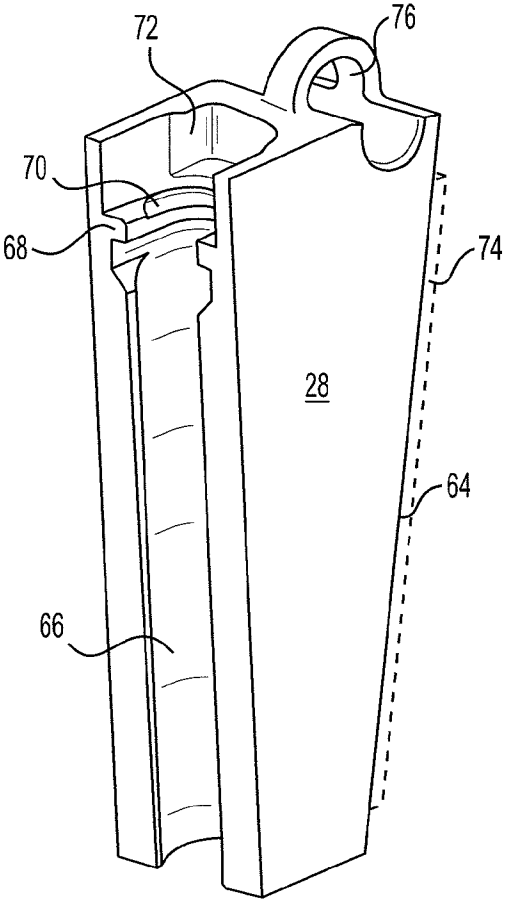
FIG. 3 is an isometric illustration of an exemplary disclosed wedge that forms a portion of the tool retention system of FIG. 2.

Wedge 28 may be located immediately adjacent outer surface 58 of clamp 26 (e.g., at a side of clamp 26 closer to cutting edge 16), and have a generally flat inclined surface 64 configured to slide against outer surface 58. With this arrangement, as wedge 28 is driven further into recess 40, clamp 26 may be forced more toward distal ends 46 of legs 38 (i.e., against the end surfaces of apertures 42, 44 and the tapered outer surfaces of legs 38). As shown in FIGS. 2-4, wedge 28 may include a longitudinal recess 66 located at a side opposite clamp 26 that is configured to receive fastener 32, and an annular protrusion 68 at a base end that extends radially inward into recess 66. In the disclosed embodiment, recess 66 may be generally circular in cross-section, and have an open side oriented away from clamp 26. It is contemplated, however, that recess 66 may have another shape, if desired, such as a square or rectangular cross-section. As shown in FIGS. 3 and 4, a cylindrical depression 70 may be formed at the base end of wedge 28 (i.e., at an outer end of recess 66), and an elongated notch 72 may extend radially outward from depression 70 toward inclined surface 64. In some embodiments, a longitudinal protrusion 74 may be formed at inclined surface 64 that is configured to engage and slide within channel 60 of clamp 26. Protrusion 74 may be omitted in some applications, if desired.

Like clamp 26, wedge 28 may also be provided with a removal feature 76 that is configured to aid in the installation and/or removal of wedge 28. In the embodiment shown in FIGS. 2-4, removal feature 76 is a cylindrical eye formed at the base end of wedge 28 and extending across a width direction of thereof. With this configuration, a pin, hook, or other fastener may be inserted into a recess of removal feature 76, and a lifting or driving force applied to the eye therewith to remove or insert wedge 28 relative to apertures 42, 44.

Figure 6:
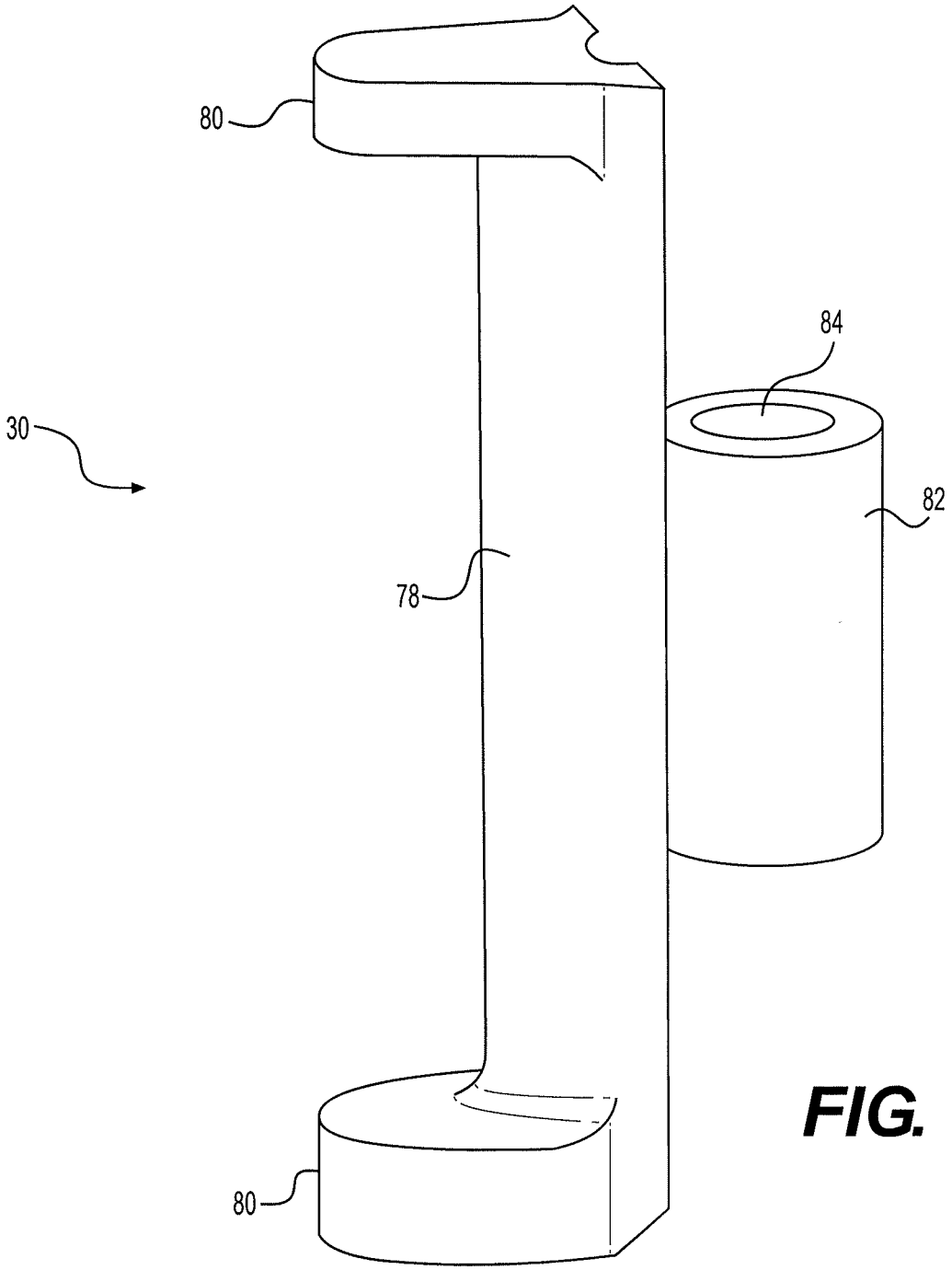
FIG. 6 is an isometric illustration of a slider that may form a portion of the tool retention system of FIG. 2.

As shown in FIG. 6, slider 30, like clamp 26, may be a generally C-shaped member, having a middle section 78, and spaced apart arms 80 located at opposing ends of middle section 78. An open side of slider 30 (relative to the C-shape) may be oriented toward cutting edge 16 (see FIG. 2) and away from clamp 26. In this configuration, arms 80 may be configured to directly engage opposing surfaces of work implement 12 at a leading end of aperture 44. A generally cylindrical protrusion 82 having a threaded bore 84 may be carried by a closed side of middle section 78 and configured to extend into recess 66 of wedge 28. Protrusion 82 may be generally aligned with recesses 66 and with a lengthwise orientation of middle section 78.

Fastener 32 may be configured to adjustably join slider 30 with wedge 28. In particular, fastener 32 may include a threaded cylindrical rod 86 and a head 88 connected to an end of rod 86. Rod 86 may be received within threaded bore 84 of slider 30, oriented in general alignment with axis 56, and configured to move linearly relative to rod 86 as head 88 is rotated. As shown in FIG. 4, head 88 may include an annular groove 90 configured to receive annular protrusion 68 of wedge 28, thereby locking linear movements of fastener 32 and wedge 28. With this arrangement, as fastener 32 is rotated within and travels linearly relative to slider 30 (slider 30 being comparatively stationary and connected to work implement 12), wedge 28 may be forced into or out of apertures 42, 44, depending on the direction of rotation. And as described above, the linear motion of wedge 28 may correspond with the clamping forces generated by clamp 26 on adapter 20 and work implement 12.

Retention cap 34 may have geometry designed to inhibit unintentional rotation of fastener 32, once retention system 22 is fully assembled. Specifically, as shown in FIGS. 3 and 4, retention cap 34 may include a hollow and generally cylindrical body 92, and an elongated protrusion 94 that extends radially outward away from body 92. Body 92 may include an open end 96, an opposing closed end 98, and a chamfered outer edge 100 at closed end 98. The hollow interior of body 92 may be configured to receive head 88 of fastener 32, for example via an interference fit. A plurality of friction enhancing features (e.g., vertical ribs) 102 may be formed within body 92 that provide for the press fit and/or that are configured to engage and resist rotation of head 88 (e.g., of hexagonal corners of head 88) relative to retention cap 34. Features 102 may be circumferentially spaced around the hollow interior of body 92, each protruding radially inward from body 92. Once retention cap 34 is pressed into place over head 88 (i.e., such that axial outer surfaces thereof are completely recessed within wedge 28), protrusion 94 may engage interior walls of notch 72, thereby inhibiting significant rotation of retention cap 34 and fastener 32. Chamfered outer edge 100 may remove geometry likely to engage with material moving past cap 34, while also interacting with the material to generate a downward force keeping cap 34 in place. An outer lip 104 may be provided on retention cap 34 to help limit a distance that retention cap 34 may be pressed into the end of recess 66. When retention system 22 is fully assembled, retention cap 34 may be substantially isolated from clamp 26, such that relative movement between clamp 26 and wedge 28 will not dislodge retention cap 34.

Figure 5:
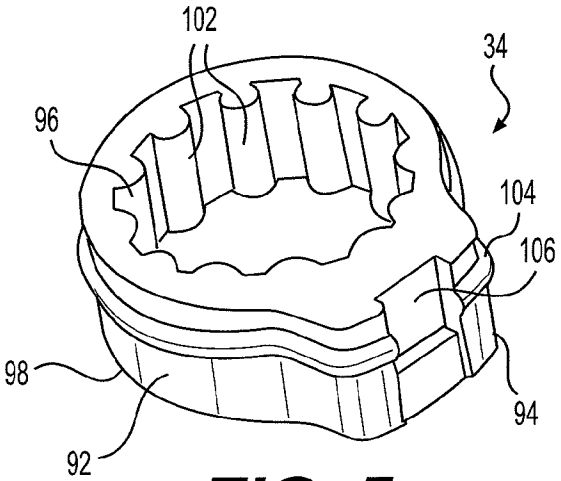
FIG. 5 is an isometric illustration of the locking cap of FIG. 4.

Retention cap 34 may be provided with a removal feature 106 at a distal end of protrusion 94 to aid in prying retention cap 34 off of head 88 during adjustment and/or disassembly. In the embodiment shown in FIG. 5, removal feature embodies a pocket formed at the open end 96. With this configuration, a tool (e.g., a flat-head screwdriver or other pry bar) may be inserted into the pocket to engage an upper edge of the pocket, and the handle of the tool forced downward against the base end of wedge 28. This action may generate a lifting force on retention cap 34 acting through protrusion 94.

INDUSTRIAL APPLICABILITY

The disclosed tool retention system may be applicable to various earth-working machines, such as wheel loaders, electric cable shovels, excavators, front shovels, dragline machines, and bulldozers. When used to removably connect ground engaging tools to the work implements of these machines, the work implements may be protected against wear in areas experiencing damaging abrasions and impacts. Accordingly, the disclosed tool retention system may help to prolong the useful life of the implements and the machines. Use of tool retention system 22 to connect GET 14 to work implement 12 will now be described in detail.

To connect a particular GET 14 to cutting edge 16 of a particular work implement 12, a service technician may first position legs 46 of adapter 20 over cutting edge 16 so that apertures 42 of adapter 20 are generally aligned with aperture 44 of work implement 12. Clamp 26 may then be inserted through apertures 42 and 44, with the open side of clamp 26 facing away from cutting edge 16. Inner surfaces 53 of arms 52 may engage the tapered surfaces at apertures 42 and sandwich legs 38 therebetween.

Once adapter 20 of GET 14 is in place relative to work implement 12, the service technician may install retention system 22 to retain GET 14 in place during operation of machine 10. To install retention system 22, the service technician may insert retention system 22 as a sub-assembly and at an angle into recess 40. That is, the service technician may insert slider 30 into recess 40 with the upper-most arm 80 tilted closer to cutting edge 16 than the lower-most arm 80. After setting the upper-most arm 80 onto the upper surface of work implement 12 at the leading end of aperture 44, the lower-most arm 80 may be rotated in a clock-wise direction (relative to the perspective of FIG. 2) until the lower-most arm 80 is located outside of work implement 12 and middle section 78 engages the leading end of aperture 44. At this point in time, inclined surface 64 of wedge 28 should be resting against outer surface 58 of clamp 26.

Once retention system 22 is positioned within apertures 42, 44, the service technician may rotate fastener 32 to tighten the connection between work implement 12 and GET 14. Specifically, as the service technician drives fastener 32 into slider 30 (e.g., by a clockwise rotation of head 88), groove 90 may engage protrusion 68 and advance wedge 28 further into recess 40. Because of the taper of wedge 28, advancement of wedge 28 into recess 40 may force clamp 26 and slider 30 away from each other. And as clamp 26 moves toward distal ends 46 of legs 38, the taper of legs 38 interacting with arms 52 of clamp 26 may result in a greater clamping force being exerted on legs 38. This force may function to sandwich work implement 12 between legs 38 of adapter 20, thereby holding GET 14 in place during operation of machine 10. Once the appropriate clamping force has been generated between work implement 12 and GET 14 by tightening of fastener 32, retention cap 34 should be pressed over head 88 and into notch 72 to inhibit unintentional reverse rotation of fastener 32 that could loosen the engagement of retention system 22.

Over time, components of work implement 12, GET 14, and retention system 22 may wear. If unaccounted for, this wear could result in failure of the connection between work implement 12 and GET 14. Accordingly, after a period of use, retention system 22 should be tightened to remove slack created by the wear. This tightening can be accomplished in two ways. First, retention cap 34 may be removed and fastener 32 driven further into recess 40, thereby causing wedges 28 to force clamp 26 and slider 30 further apart. This way of tightening the connection between work implement 12 and GET 14, however, may only be available when the associated wear is relatively low.

Once the component wear of work implement 12, GET 14, and/or retention system 22 exceeds a threshold amount, one or more portions of retention system 22 should be replaced. For example, slider 30 may be replaced to accommodate the large amount of wear that has occurred. In one example, slider 30 may be produced with a range of sizes. In this example, after the wear of work implement 12, GET 14, and/or retention system 22 has exceeded the threshold amount, the original slider 30 may be replaced with a new slider 30 having a reduced height between arms 80 and/or a middle section 78 with an increased thickness.

The disclosed retention system may be relatively simple and low-cost. Specifically, because clamp 26 and wedge 28 may engage each other at a smooth sliding surface, these components may be easy to manufacture, resulting in inexpensive parts. In addition, because excessive wear can be accommodated with replacement of relatively inexpensive components (e.g., with replacement of slider 30 as opposed to clamp 26), service costs of machine 10 may be kept low.

It will be apparent to those skilled in the art that various modifications and variations can be made to the disclosed retention system. Other embodiments will be apparent to those skilled in the art from consideration of the specification and practice of the disclosed retention system. It is intended that the specification and examples be considered as exemplary only, with a true scope being indicated by the following claims and their equivalents.

What is claimed is:

1. A tool retention system, comprising:

a generally C-shaped clamp configured to be disposed within an aperture of a work implement and to engage apertures in a tool adapter;

a wedge configured to be disposed within the apertures of the tool adapter, the wedge including:

a surface abutting against the C-shaped clamp; and
a longitudinal recess disposed opposite the surface;

a generally C-shaped slider configured to be disposed within the apertures of the tool adapter and to engage the aperture of the work implement, and having an opening oriented away from the generally C-shaped clamp; and a fastener configured to connect the generally C-shaped slider to the wedge, the fastener being disposed within the longitudinal recess.

2. The tool retention system of claim 1, wherein the generally C-shaped slider is threadingly connected to the fastener.

3. The tool retention system of claim 1, wherein:

the wedge includes an annular protrusion extending into the longitudinal recess; and the fastener includes a head having an annular groove configured to receive the annular protrusion of the wedge.

4. The tool retention system of claim 1, wherein:

the generally C-shaped clamp has a first surface that is generally flat and oriented inward relative to the apertures of the tool adapter and the work implement; and the surface of the wedge is configured to slide against the first surface.

5. The tool retention system of claim 1, wherein:

the generally C-shaped clamp has:

a first surface that is generally flat and oriented inward relative to the apertures of the tool adapter and the work implement; and a longitudinal channel formed in the first surface;

the surface of the wedge is generally flat and configured to slide against the first surface; and the wedge has a longitudinal protrusion extending from the surface and configured to be received within the longitudinal channel of the generally C-shaped clamp.

6. The tool retention system of claim 1, wherein the fastener is oriented in general alignment with an axis of the apertures of the tool adapter and the work implement, and substantially perpendicular to opposing surfaces of the work implement when assembled.

7. The tool retention system of claim 1, wherein:

the wedge includes a depression formed at a base end; and the fastener includes a head configured to seat within the depression.

8. The tool retention system of claim 7, wherein:

the wedge includes a notch extending radially outward from the depression;

the tool retention system further includes a retention cap configured to be pressed over the head of the fastener and having a protrusion configured to be received within the notch; and walls of the notch are configured to engage the protrusion and inhibit rotation of the retention cap.

9. The tool retention system of claim 8, wherein the retention cap includes:

a hollow and generally cylindrical body from which the protrusion extends radially outward; and a chamfered outer edge at a closed end of the hollow and generally cylindrical body.

10. The tool retention system of claim 9, wherein an axial outer surface of the hollow and generally cylindrical body is completely recessed within the wedge after assembly.

11. The tool retention system of claim 8, wherein the retention cap is isolated from the clamp after assembly.

12. The tool retention system of claim 1, wherein:

the generally C-shaped slider includes spaced apart arms that are configured to directly engage opposing outer surfaces of the work implement; and the generally C-shaped clamp includes spaced apart arms configured to engage outer leg surfaces of the tool adapter.

13. The tool retention system of claim 12, wherein the wedge is configured to urge a center portion of each of the generally C-shaped slider and the generally C-shaped clamp away from each other and against the work implement during rotation of the fastener.

14. A tool retention system, comprising:

a generally C-shaped clamp configured to be disposed within an aperture of a work implement and to engage apertures in a tool adapter;

a wedge configured to be disposed within the apertures of the tool adapter and the work implement and against the generally C-shaped clamp, the wedge including:

a depression formed at a base end; and a notch extending radially outward from the depression;

a generally C-shaped slider configured to be disposed within the apertures of the tool adapter and to engage the aperture of the work implement, and having an opening oriented away from the generally C-shaped clamp;

a fastener configured to connect the generally C-shaped slider to the wedge, the fastener including a head configured to seat within the depression; and a retention cap configured to be pressed over the head of the fastener and having a protrusion configured to be received within the notch, walls of the notch being configured to engage the protrusion and inhibit rotation of the retention cap.

15. The tool retention system of claim 14, wherein the wedge includes a longitudinal recess; and the fastener is disposed within the longitudinal recess at a side of the wedge opposite the generally C-shaped clamp.

16. The tool retention system of claim 15, wherein:

the wedge includes an annular protrusion extending into the longitudinal recess; and the fastener includes a head having an annular groove configured to receive the annular protrusion of the wedge.

17. The tool retention system of claim 14, wherein:

the generally C-shaped clamp has a first surface that is generally flat and oriented inward relative to the apertures of the tool adapter and the work implement; and the wedge has a generally flat second surface configured to slide against the first surface.

18. The tool retention system of claim 14, wherein:

the generally C-shaped clamp has:

a first surface that is generally flat and oriented inward relative to the apertures of the tool adapter and the work implement; and a longitudinal channel formed in the first surface; and the wedge has:

a second surface that is generally flat and configured to slide against the first surface; and a longitudinal protrusion extending from the second surface and configured to be received within the longitudinal channel of the generally C-shaped clamp.

19. The tool retention system of claim 14, wherein the fastener is oriented in general alignment with an axis of the apertures of the tool adapter and the work implement, and substantially perpendicular to opposing surfaces of the work implement when assembled.

20. The tool retention system of claim 14, wherein the retention cap includes:

a hollow and generally cylindrical body from which the protrusion extends radially outward; and a chamfered outer edge at a closed end of the hollow and generally cylindrical body.

* * * * *